US005498090A

United States Patent [19]

Lorber

[11] Patent Number: 5,498,090

[45] Date of Patent: Mar. 12, 1996

[54] APPARATUS FOR COMBINING PERFORATED PAPERS INTO STACKS

[76] Inventor: Kurt Lorber, Schurwaldstrasse 114, D-73773 Aichwald, Germany

[21] Appl. No.: 265,328

[22] Filed: Jun. 24, 1994

[30] Foreign Application Priority Data

Jun. 26, 1993 [DE] Germany ..... 43 21 317.0

[51] Int. Cl.[6] ..... B42F 13/02

[52] U.S. Cl. ..... 402/57; 402/53

[58] Field of Search ..... 402/57, 50–53, 402/73; 411/411, 414, 424, 908

[56] References Cited

U.S. PATENT DOCUMENTS

| | | | |
|---|---|---|---|
| 635,409 | 10/1899 | Van Sickle | 402/52 |
| 1,695,220 | 12/1928 | Wolf | 402/53 |
| 2,132,950 | 10/1938 | Green | 402/52 X |
| 2,560,110 | 7/1951 | Horn | 402/52 |
| 2,586,556 | 2/1952 | Mullikin | 402/57 |
| 3,102,571 | 9/1963 | Scott | 411/908 X |
| 3,251,260 | 5/1966 | Serdechny | 402/52 X |
| 4,351,626 | 9/1982 | Holmes | 411/411 X |
| 4,991,990 | 2/1991 | Frank et al. . | |
| 4,997,208 | 3/1991 | Staats, III . | |

FOREIGN PATENT DOCUMENTS

| | | | |
|---|---|---|---|
| 2256842 | 9/1975 | France | 402/57 |
| 64687 | 11/1968 | German Dem. Rep. | 402/52 |
| 372571 | 3/1923 | Germany . | |
| 841085 | 6/1952 | Germany . | |
| 916825 | 7/1954 | Germany | 402/57 |
| 8203163 | 2/1982 | Germany . | |
| 436218 | 11/1967 | Switzerland | 402/57 |
| 579995 | 9/1976 | Switzerland . | |
| 1263453 | 2/1972 | United Kingdom | 402/57 |
| 1345076 | 1/1974 | United Kingdom | 402/52 |

*Primary Examiner*—Frances Han
*Attorney, Agent, or Firm*—Quarles & Brady

[57] ABSTRACT

An apparatus for combining a stack of perforated papers contains a pin provided with a widened head, which has a round thread along its shank. The pin is passed through the holes until it abuts with its head. A nut member is screwed onto the threaded shank projecting from the other side. The pin member, together with the nut member, is manufactured by injection moulding and in one piece in a split mould.

9 Claims, 1 Drawing Sheet

APPARATUS FOR COMBINING PERFORATED PAPERS INTO STACKS

Figure 1:
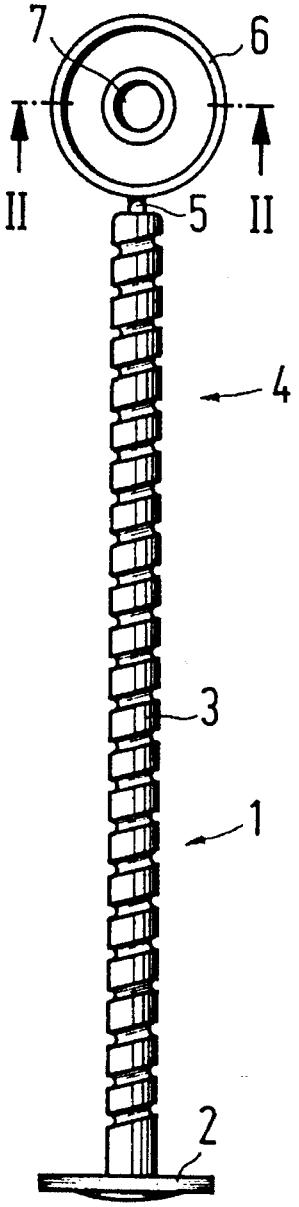

The invention relates to an apparatus for combining perforated papers into stacks.

Computer lists are printed on zig-zag folded continuous paper, which has a marginal perforation for conveying the paper. In order to be able to hold together such stacks, it is known to use threading or filing bands and the like, which are passed through a hole in all the sheets. It is known to use for this purpose flexible bands, whose ends are interconnected in the manner of closing bands.

It is also known to use pin-like elements, which have an all-round, sawtooth profiling, which are also passed through the holes and are secured on the opposite side by an engaged disk or washer. The latter can be engaged over the teeth or ribs and is secured by the latter. As a result of their symmetrical shape, these pins have the advantage that they can be easily manufactured from plastic by injection moulding in a split mold and can easily be removed from the latter. However, they suffer from the disadvantage that it is virtually impossible to remove the disk. In addition, due to the spacing of the ribs, the disk can only be fitted at discreet points, so that in certain circumstances the tension produced by the pins is not adequate to correctly secure the stack.

Attempts have already been made to injection mold in a mold plastic screws. However, the plastic screw must be unscrewed from the mold for removal purposes. However, this is only possible with screws having a specific strength and dimensions and naturally increases the costs of the manufacturing process.

The problem of the present invention is to provide a simply constructed, inexpensive apparatus which can be manufactured in large numbers, which allows a release of the apparatus and also permits a precisely adjustable holding power.

According to the invention this problem is solved by an apparatus having the features of claim 1. Further developments of the invention form the subject matter of the subclaims.

The inventor of the present invention has found that it is possible, even in the case of a split mold, to produce a thread, which can be easily removed from the mold.

According to a further development of the invention, the pin member and the nut member can be manufactured in one piece. This is naturally particularly important for manufacture and sale, because a pin is always accompanied by a nut member and the joint manufacture also makes possible joint packing without any additional stages being involved.

According to the invention the thread of the nut member need only have a single pitch. In this case the mold for the manufacture of the nut member can be made particularly simple, because only one die need be provided on both sides.

According to a further development of the invention, the nut member is shaped onto the tip of the pin by means of a separating point.

The axis of the internal thread of the nut member can be at right angles to the pin axis.

To further facilitate mold removal, the thread is a round thread, in which the pitches have rounded sides in longitudinal section. According to the invention the pitches can be flattened in the parting plane of the two mold halves.

To further improve manufacture, according to the invention the pin has in its portion with the thread an approximately elliptical cross-section. In particular, the major axis of the ellipse is located in the parting surface of the two portions of the mold parts.

Further features, details and advantages can be gathered from the claims, whose wording is made into part of the content of the description, the following description of a preferred embodiment and the attached drawings, wherein show:

FIG. 1 side view of the apparatus proposed by the invention in the finished state.

Figure 2:
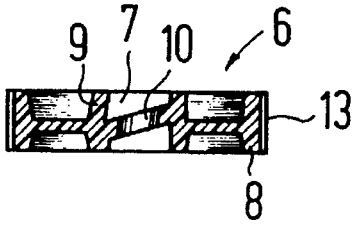

FIG. 2 a larger scale a cross-section through the nut member along line II—II of FIG. 1.

Figure 3:
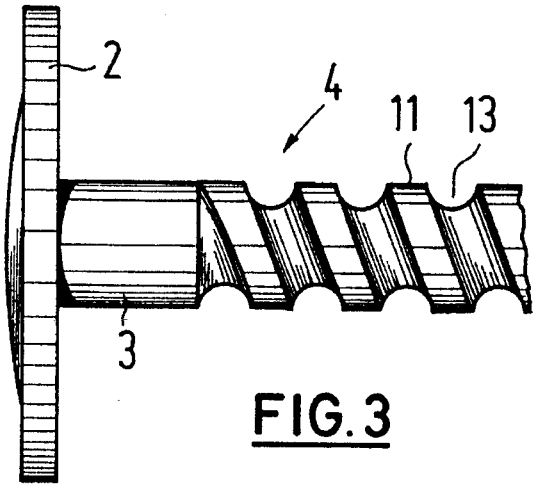

FIG. 3 On a larger scale a side view of the pin in the parting surface of the two mold halves.

Figure 4:
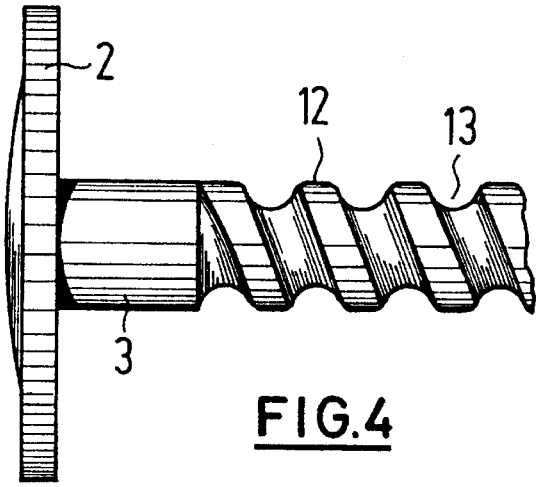

FIG. 4 side view of the pin from a direction displaced by 90° compared with FIG. 3.

The apparatus shown in the drawings contains a pin member 1 with a head 2 in the form of a flat disk, which is shaped onto one end of a shank 3. The latter has an external thread 4, which is only partly indicated in FIG. 1 and extends over virtually the entire length of the shank 3.

By means of a narrow band 5, which forms a weak point, a nut member 6 is shaped onto the tip of the pin 1. In much the same way as the head 2, the nut member 6 has a disk shape with essentially the same diameter as the latter. It contains a central hole 7, which is provided with an internal thread. The axis of this hole is at right angles to the paper plane and to the longitudinal axis of the shank 3.

In the manner shown in FIG. 1, the apparatus is injection moulded in one piece from plastic in a two-part or split mold, the parting surface between the two mold parts being located in the paper plane. The apparatus can be removed from the mold when the latter is opened.

FIG. 2 shows on an increased scale a cross-section through the nut member 6. The nut member has a height-widened marginal flange 8 and surrounding the hole 7 an equally wide inner flange 9. In the hole 7 is formed an internal thread 10, which has a single pitch. The profile shape of the thread is rounded, as can be seen on the right and left rim of the hole 7 in FIG. 2.

FIG. 3 is a partial view of the pin member 1 on a larger scale, the view being from a direction at right angles to the parting surface between the two moulds. The pitches of the external thread 4 have a semicircular profile, the thread tips between the depressions being flattened. In the represented position of the pin member 1, the outsides 11 of the pitches are linear in the longitudinal direction of the shank 3.

FIG. 4 shows the same points of the pin displaced by 90°. The outsides 12 of the pitches are rounded in the same way as the depressions 13. It is therefore a round thread with a relatively wide thread back.

The apparatus can be injection moulded from a plastics material, particularly polypropylene, in a mold split along one surface, particularly one plane, and can be removed therefrom by opening the mold. The apparatus is marketed in the form shown in FIG. 1. At the time of use the user grips the pin and tears the nut member 6 from it. This is made possible by the weak point formed by the narrow band 5. Subsequently he inserts the pin from one side through the superimposed holes of the stack of sheets and screws the nut member from the other side onto the pin. The pin can be brought into any random position along the longitudinal axis thereof. The outer rim of the marginal flange 8 can be provided with a knurling 13 in order to facilitate screwing. In the same way the nut member can be unscrewed again from the pin and the latter removed from the holes, so that the stack of sheets can be opened again.

The pin member is made from a flexible plastic. This not only facilitates the threading in a stack of sheets, whose holes are not completely aligned, but also facilitates the removal from the mold. Bendability is inter alia also possible because the pin member is tensile stressed and not shear stressed.

What is claimed is:

1. An apparatus for combining perforated papers into stacks comprising a pin member providing a head, a tip member and a shank and defining a longitudinal pin axis, said shank having an external round shank thread, and a nut member, said nut member having an internal nut thread corresponding to said external round shank thread and defining a nut thread axis, wherein said pin member and said nut member are made from a flexible plastic and are manufactured by injection molding in a mold having two mold halves and split along a parting plane.

2. An apparatus according to claim 1, wherein said pin member and said nut member are unitary but are separable, whereby the user can separate said nut member from said pin member at said tip member and thread said nut member onto said pin member at said tip member.

3. An apparatus according to claim 2, wherein said nut member is shaped onto said tip member of said pin member by means of a separating point.

4. An apparatus according to claim 2, wherein said nut thread axis is at right angles to said longitudinal pin axis.

5. An apparatus according to claim 1, wherein said external round shank thread has a single pitch.

6. An apparatus according to claim 1, wherein said pitches of said external round shank thread are flattened in said parting plane.

7. An apparatus according to claim 1, wherein said shank has an elliptical cross-section.

8. An apparatus according to claim 7, wherein the major axis of said elliptical cross-section lies in said parting plane.

9. An apparatus according to claim 1, wherein said longitudinal pin axis is located in said parting plane of said two mold halves.

* * * * *